United States Patent [19]

Castagner et al.

[11] 4,432,269

[45] Feb. 21, 1984

[54] WEAPON SYSTEM

[75] Inventors: Bernard Castagner, Coupvray par Esbly; Paul Carre, Gif sur Yvette; Gervais Moise, Choisy le Roi, all of France

[73] Assignee: Societe d'Etudes, de Realisations et d'Applications Techniques (S.E.R.A.T.), Paris, France

[21] Appl. No.: 306,937

[22] Filed: Sep. 29, 1981

[30] Foreign Application Priority Data

Oct. 14, 1980 [FR] France ..... 80 21901

[51] Int. Cl.[3] ..... F41F 3/04

[52] U.S. Cl. ..... 89/1.816; 42/15

[58] Field of Search ..... 89/1.816, 1.819, 1.8, 89/1.813, 1.814, 1.5 S; 42/1 S

[56] References Cited

U.S. PATENT DOCUMENTS

| | | | |
|---|---|---|---|
| 3,494,249 | 2/1970 | Choate | 89/1.816 X |
| 3,732,642 | 5/1973 | Bray | 42/1 S |
| 3,750,529 | 8/1973 | Reed et al. | 89/1.816 |
| 3,990,355 | 11/1976 | Looger et al. | 42/1 S X |
| 4,128,039 | 12/1978 | Skliris | 89/1.816 X |
| 4,153,282 | 5/1979 | Clodfelter | 89/1.816 X |
| 4,227,438 | 10/1980 | Precoul | 89/1.816 |

*Primary Examiner*—David H. Brown

*Attorney, Agent, or Firm*—Wenderoth, Lind & Ponack

[57] ABSTRACT

A light-weight anti-tank weapon for use by infantry consists of a launching tube for a projectile such as a rocket contained either directly in the tube or in a container which, when firing takes place, forms an extension of the tube. To enable the weapon to be used either by a right-handed or left-handed marksman, the fittings associated with the weapon are symmetrical in relation to the longitudinal plane when the weapon is ready to be fired, and certain elements of the weapon, particularly an optical aiming device and a shoulder-piece, can be secured to one of the two sets of suitable supports or mountings in the right-hand and left-hand positions, respectively.

12 Claims, 8 Drawing Figures

WEAPON SYSTEM

BACKGROUND OF THE INVENTION

The present invention relates to a weapon system, such as an anti-tank rocket launcher.

For many years, tanks have been the decisive elements on the battlefield. The infantry is provided with means designed to destroy them, and in particular with weapons having heads with hollow charges. However, the recent rapid developments in armoured vehicles obliges the infantry to be equipped with new anti-tank weapons.

With the appearance of new, more efficient armour-plating, the protection of tanks has improved, whilst the tactical mobility of armoured vehicles has also increased considerably.

On the other hand, in modern warfare, the infantry needs to be very mobile and for this purpose will use, for example, smaller vehicles capable of executing a large number of rapid manoeuvres.

SUMMARY OF THE INVENTION

The object of the present invention is to provide a weapon system, particularly for use by infantry against tanks.

The present invention provides a weapon system, particularly a light-weight anti-tank weapon for use by infantry and comprising a launching tube or gun barrel for a projectile such as a rocket contained either directly in the tube or in a container which, when firing takes place, forms an extension of the tube. The weapon system is characterized in that, to enable it to be used either by a right-handed or left-handed marksman, the fittings associated with the weapon are symmetrical in relation to the longitudinal plane when the weapon is ready to be fired and include an optical aiming device and a shoulder-piece which can be secured to either one or two sets of suitable supports in the right-hand and left-hand positions, respectively.

The weapon system is preferably constituted by a gun barrel and a hollow-charge rocket keyed into its container which, when firing takes place, forms an extension to the gun barrel, as this allows accommodating the components in the smallest possible space and ensures ease in firing.

To ensure that the propellant functions reliably and safely, the weapon system preferably comprises a firing system and the source of energy therefor which are mounted on the container which extends the barrel.

In that the fittings of the weapon, when the latter is ready for firing, are symmetrical in relation to the longitudinal plane, the weapon can readily be fired by an infantryman whether right-handed or left-handed, and this is achieved without doubling the number of fittings, i.e. the number of aiming devices and shoulder-pieces.

The mounting of the optical aiming means is achieved by arranging, on the gun barrel, the aforesaid two supports for the optical aiming means, which supports should be at a suitable angular distance apart so that the range-table is appropriately located in relation to the hair lines associated with the optical system.

Preferably, the optical aiming means is arranged to be locked in position on either support by a rapid locking means such as, for example, a quick-release catch. The objective part can be rigidly and accurately connected by the locking means to the gun barrel, whereas the ocular part can be opened out to ensure comfort during firing and to protect the optical system during transportation.

The comfort of the marksman can be ensured by providing, on the container, two supports for shoulder straps or shoulder-pieces, which clip into these supports.

The gun barrel and the container are preferably fitted together by introducing the gun barrel into the container tube. Thus, during firing and passage of the rocket into the assembled weapon, the gases of combustion create a force which tends to expand the two barrel elements outwardly towards each other, and such gases contribute towards rendering the weapon airtight during firing. The assembly may be held together by a rapid-action attachment system such as, in particular, a catch arrangement.

Still within the framework of the invention, the gun barrel and the container may also be assembled by introducing the container into the gun barrel. Locking is then preferably achieved by means of helicoidal ramps.

To reduce the mass of the weapon system as much as possible, the gun barrel and the extension container may be made of a wound mixture of fibre and synthetic resin, preferably aramide/epoxy resin.

To enable the weapon to resist shock and thermal radiation during its use, the gun barrel and the container tube can be covered with a "skin" made of multi-layer materials adapted to absorb shock and thermal radiation, such as a multi-layer wrapping of closed-cell foam material and aluminium foil.

The rocket used with the weapon is preferably a hollow charge rocket having the features disclosed in the U.S. patent application Ser. No. 928,154, filed on July 26, 1978 by Michel Precoul.

BRIEF DESCRIPTION OF THE DRAWINGS

The above and other features and advantages of the invention will become further apparent from the following description, given by way of example of a typical embodiment of a weapon system according to the invention as shown in the accompanying drawings, in which.

DETAILED DESCRIPTION OF THE INVENTION

Figure 1:
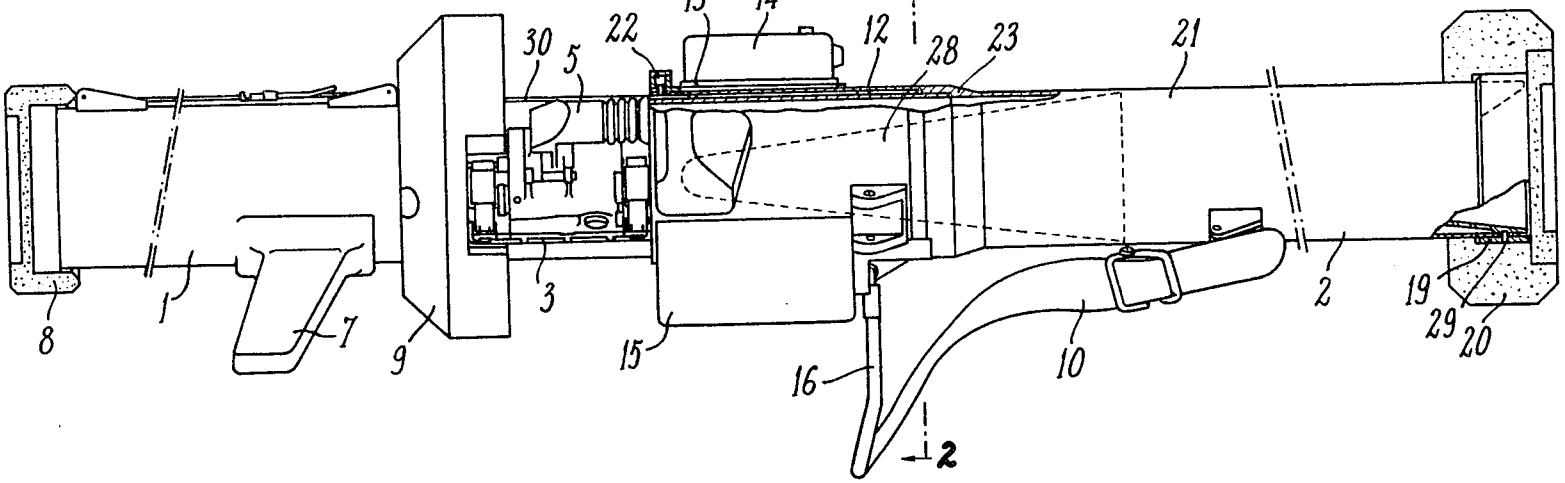
FIG. 1 is a longitudinal view of the assembled weapon.

Referring to the drawings, the weapon system shown comprises a launching tube or gun barrel 1 and a container 2 which extends the gun barrel and accommodates a rocket 28 keyed by a pin 29.

Figure 8:
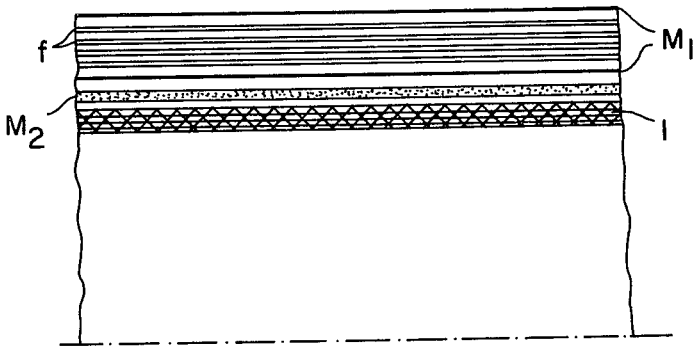
FIG. 8 is an enlarged cross section showing the construction of the gun barrel and a shock and thermal radiation resistant layer thereon.

The gun barrel of the invention is preferably made of a mixture of wound fibres and synthetic resin and particularly aramide/epoxy resin, as shown schematically in the middle portion of FIG. 8.

Figure 5:
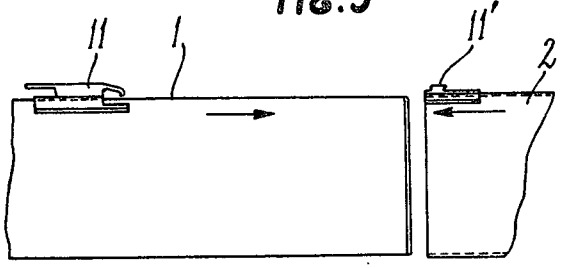
FIGS. 4 and 5 illustrate respective details of means for assembling the gun barrel and the container tube.

The gun barrel 1 comprises the following fittings:

a support 3 for an optical aiming device in the form of a fold-up aiming telescope 5 for a right-handed marksman, and a support 4 for the optical aiming device for a left-handed marksman, each support including a quick-release catch member 6 for securing the telescope 5 to the respective support;

a front grip 7;

a muzzle ring 8;

a central shock-absorbing cap 9;

a sling 10;

a locking catch arrangement 11—11′ (see FIG. 5), and centering bearings 12; and electrical connections 30 between a battery case and the telescope.

The container tube 2 is preferably also made of a mixture of wound fibres and synthetic resin and in particular aramide/epoxy resin.

Figure 3:
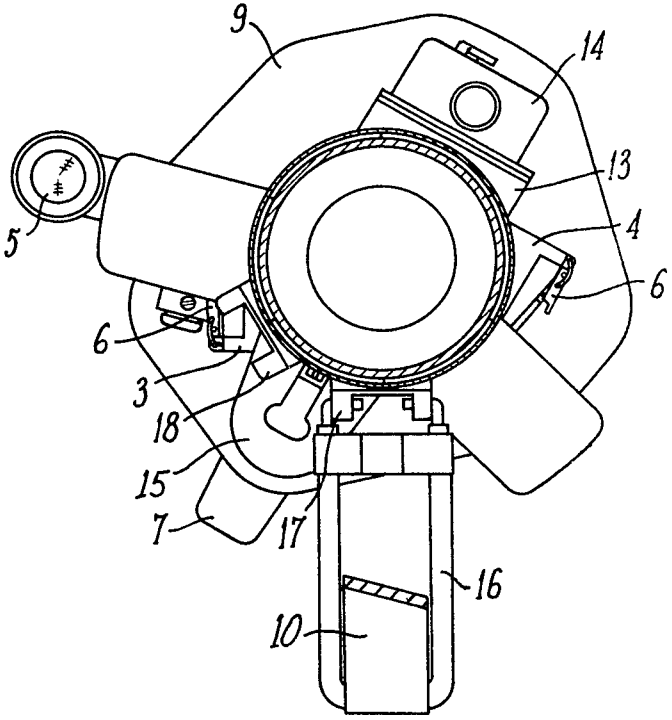
FIG. 3 illustrates, on a larger scale, a cross-sectional view similar to that of FIG. 2, the weapon being assembled for use by a right-handed marksman.
Figure 2:
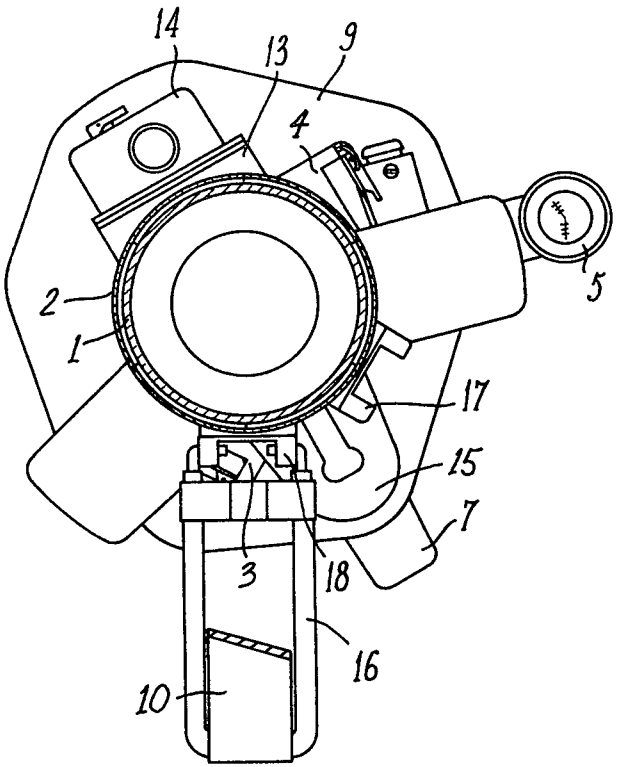
FIG. 2 is, on a larger scale, a cross-sectional view, taken approximately along line 2—2 of FIG. 1, of the weapon assembled for use by a left-handed marksman.

The container tube 2 comprises the following fittings:

a support 13 which accommodates an ignition case 14;

a case 15 containing batteries;

a foldable shoulder-piece 16, to which is connected sling 10, and shoulder-attachments or mountings 17 and 18, respectively, for use by right-handed and left-handed marksmen (FIGS. 2 and 3);

a rear ring 19 and a protective cap 20;

electrical ignition connections 21;

a contact stud 22 for the connections to the ignition case and the aiming telescope;

a chamfered portion 23, the bore of which centres the container 2, at its front part, on the tube 1 at the periphery and rear face of tube 1.

Figure 6:
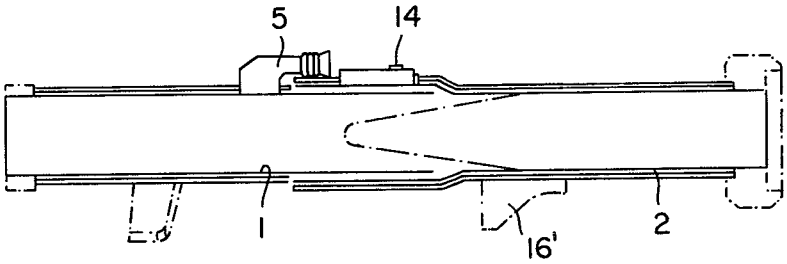
FIG. 6 is a simplified schematic longitudinal section of the embodiment of FIG. 1, but illustrating a modified shoulder-piece not employing a shoulder strap or sling.

FIG. 6 shows a modified shoulder-piece 16′ which may replace the foldable member 16 and strap 10. It is to be understood however that any conventional shoulder assembly may be employed in the present invention.

Figure 7:
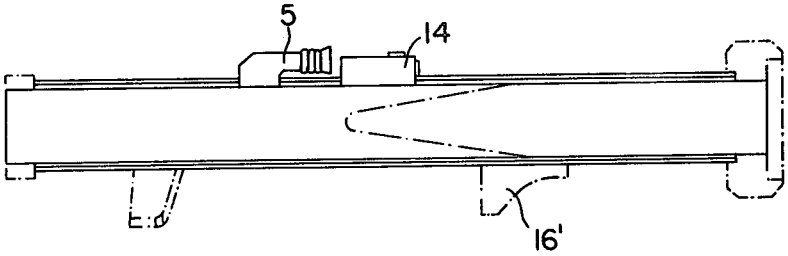
FIG. 7 is a view similar to FIG. 6, but showing a modification wherein the gun barrel itself forms the container for the rocket.

In a further embodiment of the invention, the gun barrel does not have an extension, the barrel itself forming the container for the rocket. In this variant, shown schematically in FIG. 7, the following are integrated in the gun barrel:

the support for the ignition case 13;

the battery case 15;

the shoulder-piece attachments or mountings 17 and 18;

the rear rings 19 and the protective cap 20;

the electrical ignition connections 21 and the connection for the ignition case and the telescope.

Figure 4:
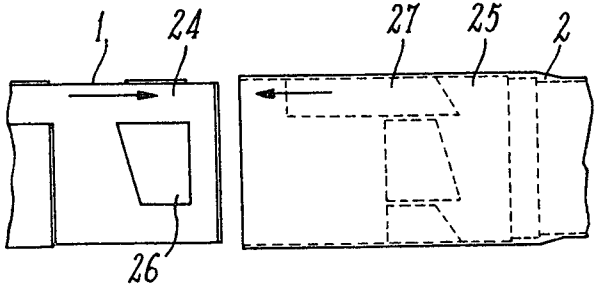

The fitting together and locking of the gun barrel and its container may also be achieved by a system of helicoidal ramps as illustrated in FIG. 4 and comprising:

two cylindrical bearing surfaces 24 and 25;

female ramps 26 on the gun barrel 1;

male ramps 27 on the container 2.

To enable the weapon to resist shock and thermal radiation during its use, the gun barrel and the container tube can be covered with a "skin" made of multi-layer materials adapted to absorb shock and thermal radiation, such as a multi-layer wrapping of closed-cell foam material and aluminum foil. One possible such skin is shown at the top of FIG. 8, wherein there is illustrated layers $M_1$ and $M_2$ of materials capable of absorbing shock, e.g. closed cell foam material, and layers f of material resistant to thermal radiation, e.g. aluminum foil.

This invention is not, of course, limited to the various forms of construction described and illustrated, but covers all the variants thereof within the scope of the claims.

We claim:

1. A weapon system, particularly a light weight anti-tank weapon for use by infantry, said weapon system comprising:

a barrel member for launching a projectile such as a rocket;

a container member extending rearwardly from said barrel member for containing the projectile prior to firing;

first and second shoulder-piece mountings spaced circumferentially about said container member;

a shoulder-piece selectively connectable to either of said first and second shoulder-piece mountings;

first and second aiming device mountings spaced circumferentially about said barrel member;

an optical aiming device selectively connectable to either of said first and second aiming device mountings;

said shoulder-piece mountings and said aiming device mountings being relatively positioned such that when said shoulder-piece and said aiming device are connected to the respective said first mountings thereof the weapon system is suitable for a right-hand operator, and such that when said shoulder-piece and said aiming device are connected to the respective said second mountings thereof the weapon system is suitable for a left-handed operator.

2. A weapon system as claimed in claim 1, further comprising rapid locking means for connecting said aiming device to either one of said mountings thereof.

3. A weapon system as claimed in claim 1, further comprising an ignition system mounted on said container member.

4. A weapon system as claimed in claim 1, wherein said barrel member and said container member comprise a single integral element.

5. A weapon system as claimed in claim 1, wherein said barrel and container members are formed of a mixture of wound fibers and synthetic resin.

6. A weapon system as claimed in claim 5, wherein said mixture comprises aramide and epoxy resin.

7. A weapon system as claimed in claim 1, wherein said barrel and container members are covered with a multi-layer shock and radiation absorbing wrapping.

8. A weapon system as claimed in claim 7, wherein said wrapping comprises layers of closed-cell foam material and aluminum foil.

9. A weapon system as claimed in claim 1, wherein said barrel member and said container member comprise separate elements, with the rear end of said barrel member extending into the forward end of said container member.

10. A weapon system as claimed in claim 9, wherein said forward end of said container member comprises an enlarged portion centering said container member on the outer periphery and rear end face of said barrel member.

11. A weapon system as claimed in claim 9, further comprising a locking catch arrangement for holding together said barrel and container members.

12. A weapon system as claimed in claim 9, further comprising helicoidal ramps for locking together said barrel and container members.

* * * * *